US010657931B2

(12) United States Patent
Shaw et al.

(10) Patent No.: US 10,657,931 B2
(45) Date of Patent: May 19, 2020

(54) LIGHTWEIGHT BODY CONSTRUCTION FOR STRINGED MUSICAL INSTRUMENTS

(71) Applicant: Fender Musical Instruments Corporation, Scottsdale, AZ (US)

(72) Inventors: Timothy P. Shaw, Hendersonville, TN (US); Joshua D. Hurst, Nashville, TN (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 15/923,350

(22) Filed: Mar. 16, 2018

(65) Prior Publication Data

US 2019/0287496 A1 Sep. 19, 2019

(51) Int. Cl.

| | |
|---|---|
| ***G10D 1/08*** | (2006.01) |
| ***G10D 3/06*** | (2020.01) |
| ***G10D 3/10*** | (2006.01) |
| ***G10D 3/04*** | (2020.01) |

(52) U.S. Cl.

CPC ..... *G10D 1/085* (2013.01); *G10D 3/04* (2013.01); *G10D 3/06* (2013.01); *G10D 3/10* (2013.01)

(58) Field of Classification Search

CPC ..... G10D 1/085; G10D 3/04; G10D 3/06; G10D 3/10; G10D 3/02; G10D 1/005

See application file for complete search history.

(56) References Cited

U.S. PATENT DOCUMENTS

| | | | | |
|---|---|---|---|---|
| 2,674,912 | A | 4/1954 | Petek | |
| 3,641,862 | A | 2/1972 | Rendell | |
| 4,103,583 | A | 8/1978 | Takabayashi | |
| 4,334,452 | A | 6/1982 | Morrison, III et al. | |
| 4,364,990 | A | 12/1982 | Haines | |
| 4,963,214 | A * | 10/1990 | Iwata | B32B 27/04 156/276 |
| 5,054,356 | A | 10/1991 | Farnell, Jr. | |
| 5,235,891 | A | 8/1993 | Klein | |
| 6,011,205 | A | 1/2000 | Tucker et al. | |
| 6,114,616 | A * | 9/2000 | Naylor | G10D 3/02 84/290 |
| 6,359,208 | B1 | 3/2002 | Farnell, Jr. | |
| 6,683,236 | B2 | 1/2004 | Davis et al. | |
| 6,770,804 | B2 | 8/2004 | Schleske | |

(Continued)

*Primary Examiner* — Kimberly R Lockett

(74) *Attorney, Agent, or Firm* — Brian M. Kaufman; Robert D. Atkins; Patent Law Group: Atkins and Associates, P.C.

(57) ABSTRACT

A musical instrument includes a softwood core and an opening formed in the softwood core. The softwood core is formed by combining a plurality of softwood boards. A hardwood plug is disposed in the opening of the softwood core. A first hardwood plate is disposed over a first surface of the softwood core. A second hardwood plate is disposed over a second surface of the softwood core. The hardwood plug extends from the first hardwood plate to the second hardwood plate. The softwood core, first hardwood plate, and second hardwood plate are cut into an instrument body. An instrument neck is attached to the instrument body. A bridge is attached to the hardwood plug using a screw or other fastener extending through the bridge and into the hardwood plug. An opening is formed through the hardwood plug. A string is disposed through the opening of the hardwood plug.

25 Claims, 22 Drawing Sheets

(56) References Cited

U.S. PATENT DOCUMENTS

| | | | | |
|---|---|---|---|---|
| 6,888,054 | B2 | 5/2005 | Minakuchi | |
| 7,141,730 | B1 | 11/2006 | Wu | |
| 7,208,665 | B2 | 4/2007 | Schleske | |
| 7,235,728 | B2 | 6/2007 | Schleske | |
| 7,420,107 | B2 | 9/2008 | Parker et al. | |
| 7,452,585 | B1 * | 11/2008 | Wong | C08J 9/00 264/176.1 |
| 7,482,518 | B1 | 1/2009 | DiSanto | |
| 7,498,497 | B2 | 3/2009 | Ito | |
| 7,507,885 | B2 | 3/2009 | Coke | |
| 7,598,444 | B2 | 10/2009 | Farnell, Jr. | |
| 7,863,507 | B2 | 1/2011 | Ayers | |
| 9,165,539 | B2 | 10/2015 | Ostosh | |
| 9,208,756 | B2 | 12/2015 | Isaac | |
| 9,607,588 | B2 * | 3/2017 | Austin | G10D 1/005 |
| 9,818,380 | B2 | 11/2017 | Luttwak | |
| 9,852,718 | B1 | 12/2017 | Kelly | |
| 2011/0219932 | A1 * | 9/2011 | Gembar | G10D 3/06 84/291 |

* cited by examiner

LIGHTWEIGHT BODY CONSTRUCTION FOR STRINGED MUSICAL INSTRUMENTS

FIELD OF THE INVENTION

The present invention relates in general to musical instruments and, more particularly, to a lightweight body construction for stringed musical instruments.

BACKGROUND OF THE INVENTION

Using a solid plank of wood to construct an electric guitar dates to the early 1930's when the concept was first developed for "Hawaiian" or "lap steel" guitars. These instruments were simple planks or laminated blocks designed for ease of manufacture, and were typically made of maple, mahogany, or other hardwoods. Electric guitars in the late 1940's incorporated a removable neck made of maple, and the bodies were made of various hardwoods, such as ash, or softwoods, such as pine or spruce. Other manufacturers began to produce solid body guitars using primarily mahogany and maple, although basswood and poplar were also used.

While the focus in material selection was on sound and manufacturability, the weight of the instrument was also a factor due to the negative effect on player comfort for heavier instruments. Guitar makers quickly appreciated that hardwoods were easier to work with in a factory situation because the hardwood materials were less susceptible to handling damage, so most guitar makers utilized lightweight ash, and later alder, for the guitar bodies. While guitar players appreciated the sound of the pine and spruce instruments, those softwood instruments were made in very small quantities due to manufacturing difficulties. Softer woods, while capable of producing a pleasing tone, lead to an increase in handling damage during manufacturing, may flex under string tension, which reduces playability, and do not hold screws and other fasteners as effectively as hardwood, further complicating manufacturing.

Modern players often prefer instruments that are light in weight, and builders have returned to the softwoods for body materials. However, the issues of making a body without damage during construction, distortion of the body due to string tension, and difficulties with fasteners remain. Therefore, a need exists for a guitar body design that utilizes lightweight materials for construction while overcoming the problems facing softwood guitar body manufacturing.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings. While the invention is described in terms of forming a guitar, the disclosed construction technique is also useable for bass guitars and other stringed musical instruments having a solid body construction.

Figure 1A:
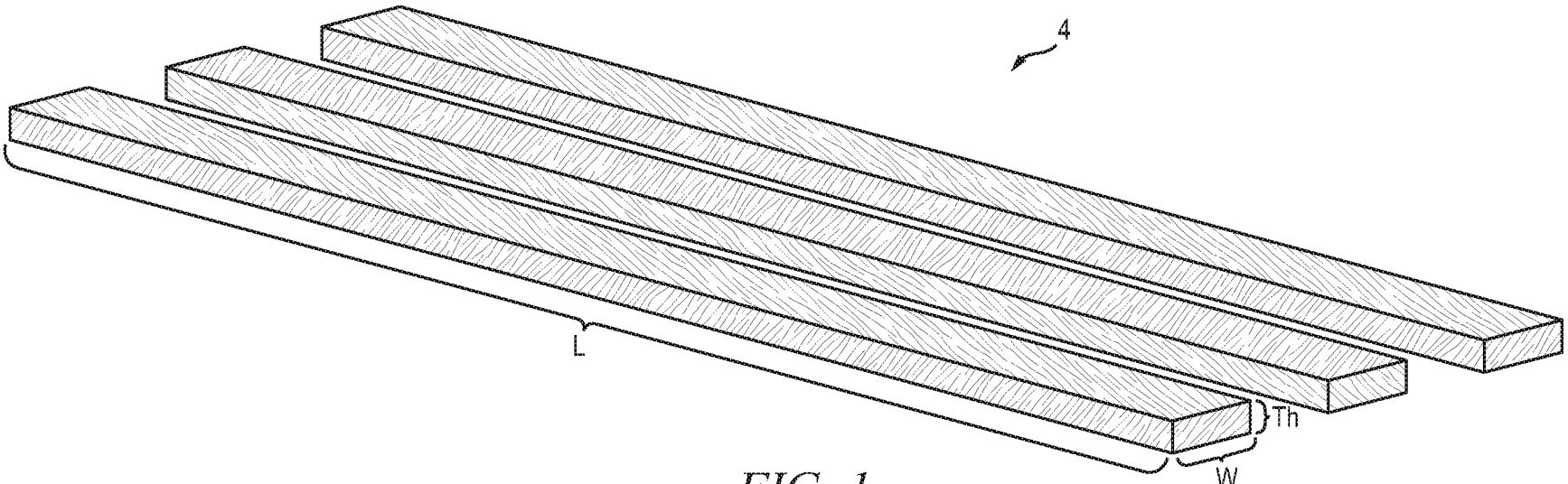
FIGS. 1*a*-1*h* illustrate forming a softwood core with a hardwood plug for a guitar blank.

FIG. 1*a* illustrates a plurality of softwood boards 4. Softwood boards 4 are rough lumber used as the raw material for manufacturing a guitar. Softwood boards 4 are milled from softwood tree trunks into boards to have a thickness desired for a core of a subsequently formed guitar. In one embodiment, softwood boards 4 include a thickness of 1.5 inches. Softwood boards 4 are formed from any of a variety of softwood trees, e.g., balsa, cedar, paulownia, spruce, pine, basswood, or poplar. Other softwoods are used in other embodiments. In some embodiments, wood from trees technically categorized as hardwood trees is used for softwood boards 4, due to the wood being relatively lightweight. In other embodiments, lightweight non-organic materials are used, e.g., expanded polystyrene.

Softwood boards 4 are generally purchased having a thickness approximately equal to the desired thickness for a guitar body core. The thickness dimension of softwood boards 4 is labelled as "Th" in FIG. 1*a*. In other embodiments, multiple softwood boards are stacked and glued to combine the thicknesses of multiple boards, thus creating a guitar body thicker than a single board 4.

Length, labelled "L" in FIG. 1*a*, and width, labelled "W", of softwood boards 4 varies with the cut of the wood. Generally, softwood boards 4 are significantly longer than required to form a guitar body, and are cut to a desired guitar body length using saw blade 8 as shown in FIG. 2*b*. Softwood boards 4 can also be cut by a laser cutting tool, water jet, or other suitable wood cutting means.

Figure 1B:
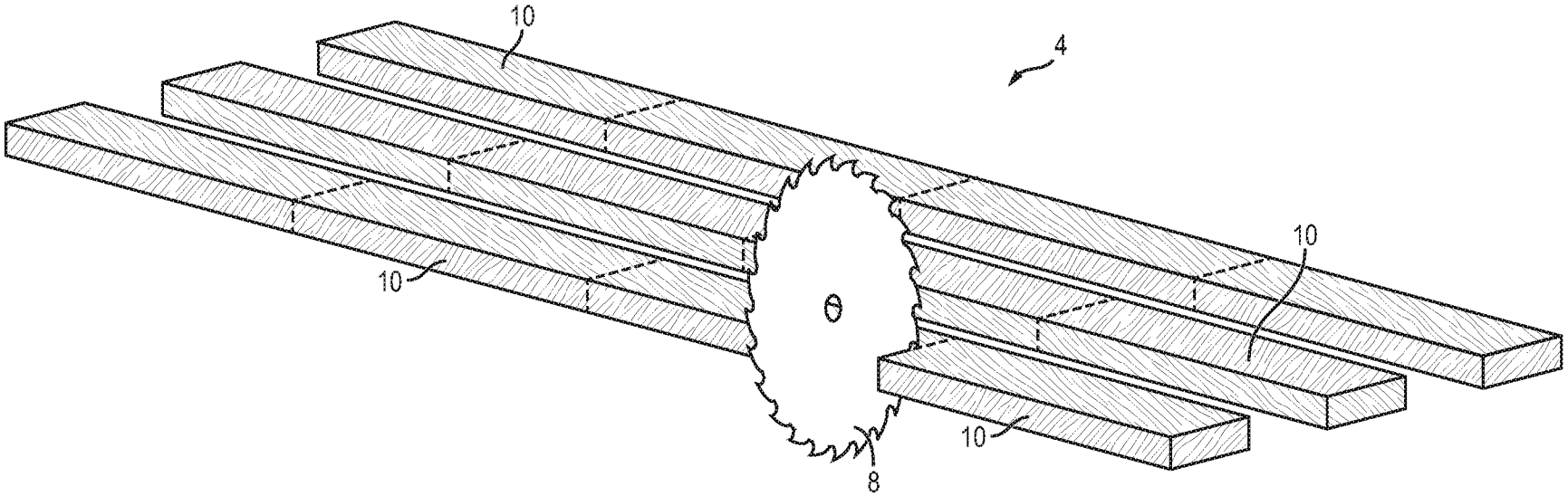
Figure 1C:
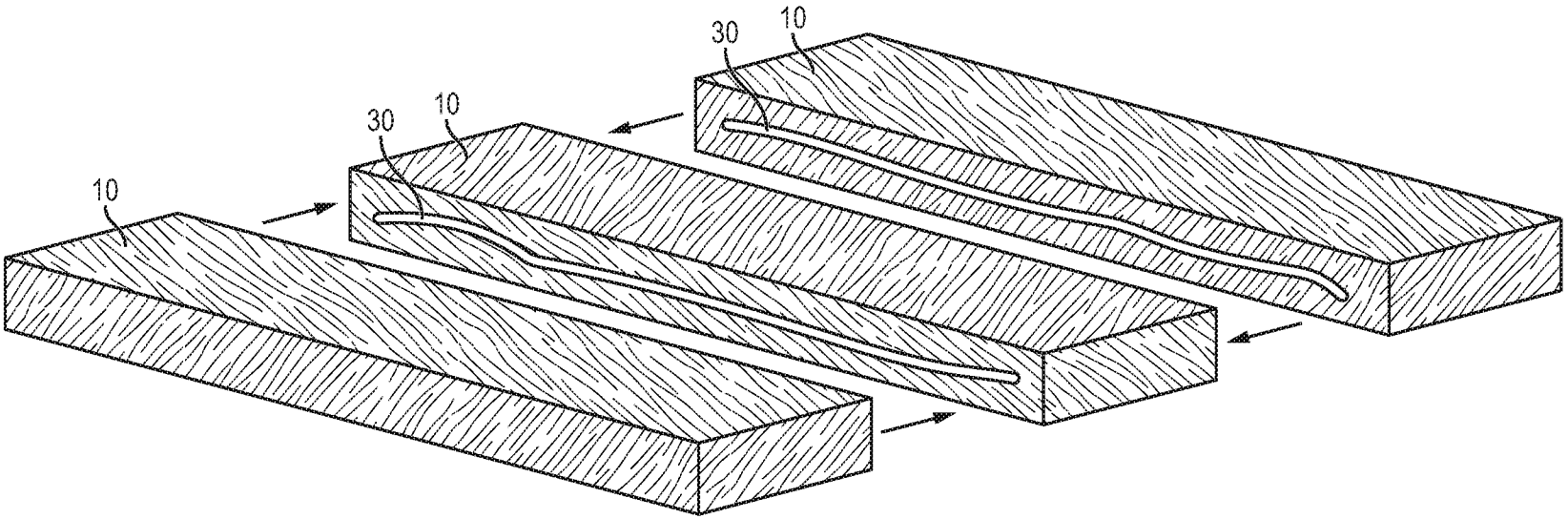
Figure 1D:
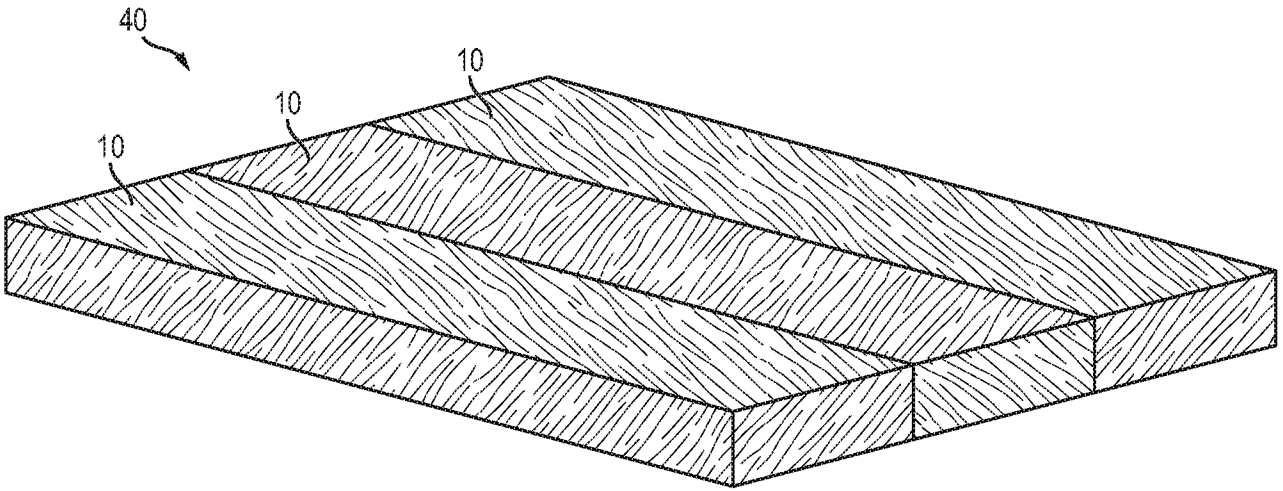

Generally, softwood boards 4 have a width that is insufficient for forming a guitar body. A plurality of cut softwood boards 10 are glued together using wood glue 30 in FIG. 1*c* to combine the widths of the boards. Wood glue 30 is shown as a bead of glue for ease of illustrations. However, wood glue 30 is also applied as a layer over entire surfaces of the cut boards 10 using a brush, roller, sprayer, or other suitable mechanism in other embodiments. When a bead of glue 30 is used, pressing adjacent cut boards 10 against each other spreads the glue across the contacting wood surfaces. Gluing multiple cut softwood boards 10 together allows the widths of the cut boards to be combined to form a softwood core 40 in FIG. 1*d* that has a sufficient width to form a guitar body. In some embodiments, especially where synthetic materials are used, the raw materials are purchased or manufactured in a size sufficient for core 40 without having to combine multiple pieces of material or cut the material into pieces.

Figure 1E:
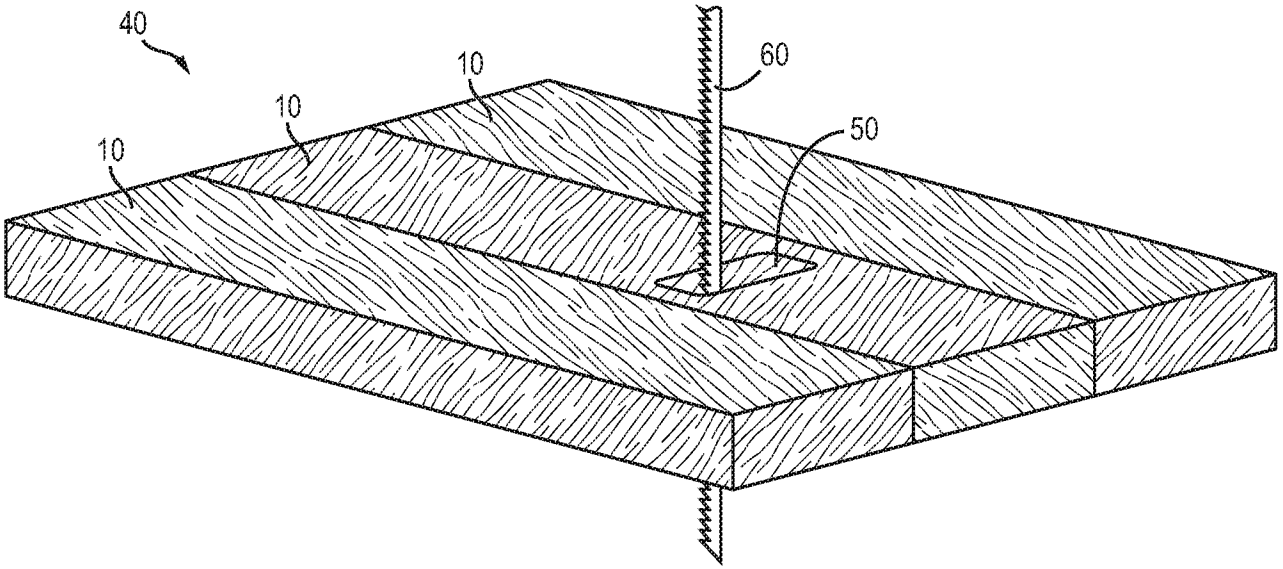

In FIG. 1*e*, an opening 50 is formed through softwood core 40 using a reciprocating saw blade 60, e.g., a jigsaw or scroll saw. Other types of saws, milling, water cutting, or laser cutting are used in other embodiments to form opening 50. Any of the cutting mechanism can be computer numerical control (CNC) processes for improved accuracy. Opening 50 extends completely through core 40. The location of opening 50 is selected as the location where a guitar bridge will be mounted to the guitar body subsequently cut from core 40.

Figure 1F:
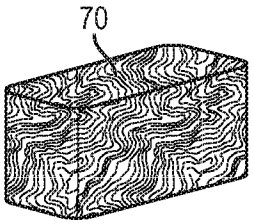

FIG. 1*f* illustrates a hardwood plug 70 configured to fill opening 50 in core 40. Hardwood plug 70 is formed from a significantly heavier, and thus denser, wood than softwood boards 4, e.g., Sitka spruce, walnut, rosewood, ash, alder, maple, or mahogany. Hardwood plug 70 can be formed of wood cut from trees that are technically classified as softwood if the material is relatively dense and capable of providing sufficient attachment strength for fasteners used to attach a guitar bridge. In other embodiments, non-organic materials with a greater strength than the material of softwood boards 4 is used for plug 70, e.g., carbon fiber, brass, aluminum, steel, bone, etc.

Figure 1G:
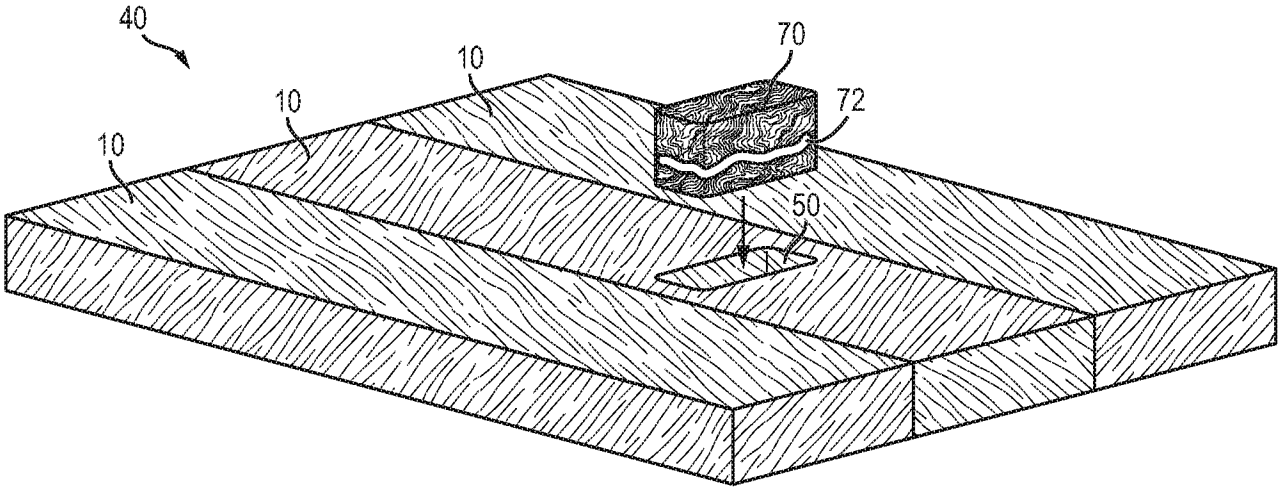

Hardwood plug 70 is shaped into substantially the same shape as opening 50 so that when the hardwood plug is inserted into opening 50 in FIG. 1*g*, there is little to no visible gap. Hardwood plug 70 can be formed using a CNC process similar to the formation of opening 50, which helps in matching sizes of the plug and opening. A thickness of hardwood plug 70 is approximately equal to softwood core 40 such that the top and bottom surfaces of hardwood plug 70 and softwood core 40 are coplanar with each other once the plug is inserted in opening 50.

Figure 1H:
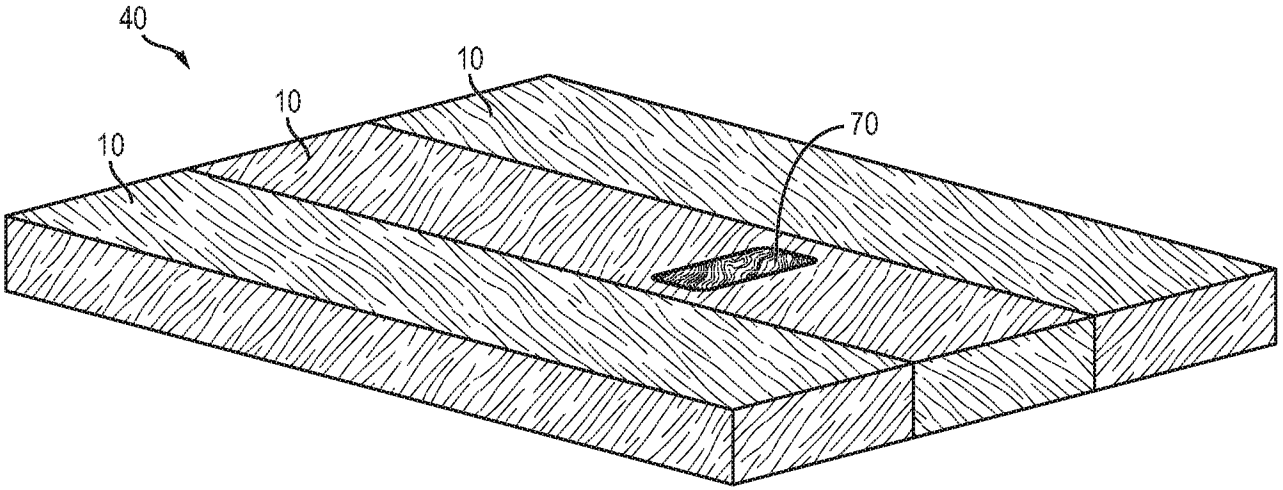

Hardwood plug 70 is glued into opening 50 with wood glue 72. In other embodiments, hardwood plug 70 is press fit into opening 50 to hold the plug without an adhesive. In one embodiment, plug 70 remains loose in opening 50, and is held in place by the hardwood plates applied in FIGS. 2*a*-2*d* below. Opening 50 has a relatively small footprint so that the vast majority of softwood material remains in softwood core 40, e.g., at least 90 or 95 percent of the softwood material remains to keep softwood core lightweight. Hardwood plug 70 is just large enough to reliably mount a bridge when manufacturing a guitar. FIG. 1*h* illustrates softwood core 40 with hardwood plug 70 inserted.

Figure 2A:
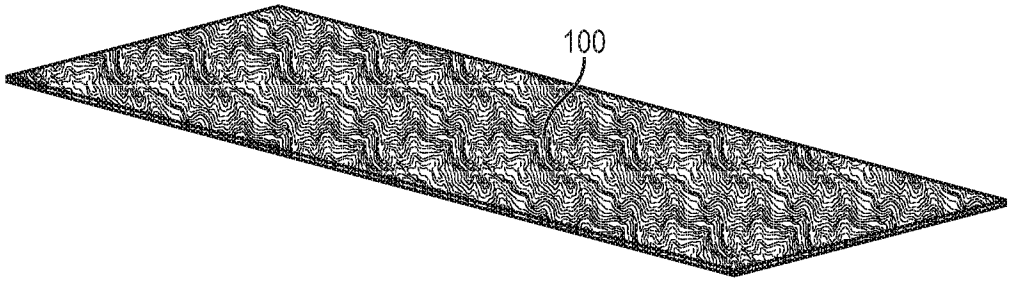
FIGS. 2*a*-2*d* illustrate completing the guitar blank by adding hardwood plates.
Figure 2B:
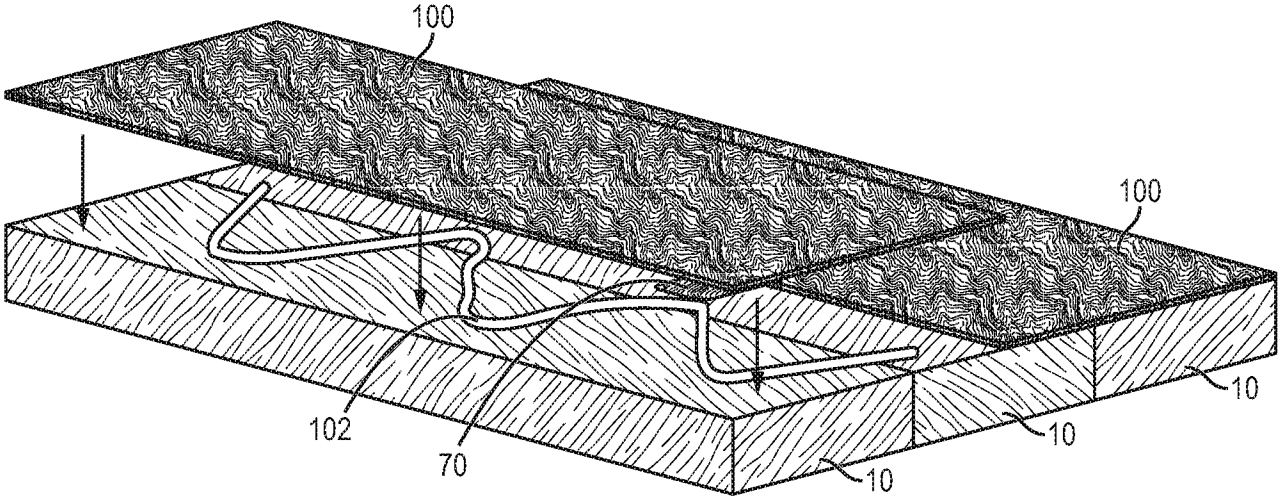

FIG. 2*a* illustrates a hardwood board 100 used to form hardwood plates on the top and bottom of the softwood core 40. Hardwood boards 100 are similar to softwood boards 4, in that the boards are raw lumber cut from tree trunks. However, hardwood boards 100 are formed from a harder and stronger material than softwood boards 4, such as those materials mentioned above for hardwood plug 70. Hardwood boards 100 are also usually much thinner than the thickness of softwood boards 4. In some embodiments, hardwood boards 100 form merely a veneer over softwood core 40. A thickness of hardwood boards 100 can be as thin as 1/32 or 1/40 of an inch, or as thick as 1/8 to 3/16 inches. Any thickness outside of that range is used in other embodiments to achieve a desirable ratio of softwood to hardwood in the guitar body. Hardwood boards 100 may be cut from longer lumber, as in FIG. 1*b* for the softwood boards, but that step is not illustrated.

In FIG. 2*b*, hardwood boards 100 are glued onto the top and bottom surfaces of softwood core 40 and hardwood plug 70. Wood glue 102 is used to attach hardwood boards 100 to softwood core 40. Wood glue 102 can be applied as a layer totally covering the surfaces of softwood core 40 or hardwood boards 100. Multiple pieces of hardwood board 100 are used to form a guitar blank 110 having top and bottom hardwood plates 114 in FIG. 2*c*.

Hardwood plates 114 have substantially the same footprint size as softwood core 40. As illustrated, hardwood boards 100 have a greater width than the cut softwood boards 10, so only two hardwood boards are used to cover the entire width of the three softwood boards. In other embodiments, any number of hardwood and softwood boards is used. The number of hardwood boards 100 per plate 114 may be less than, more than, or equal to the number of softwood boards 10 used to form core 40. In one embodiments, the lengths of hardwood boards 100 are oriented perpendicular to softwood boards 10, rather than parallel as illustrated. In some embodiments, the raw materials for plates 114 are manufactured to sufficient size that only a single piece of material is required for each plate, e.g., when synthetic materials are used or with a wood veneer thin enough to be rotary cut.

Figure 2C:
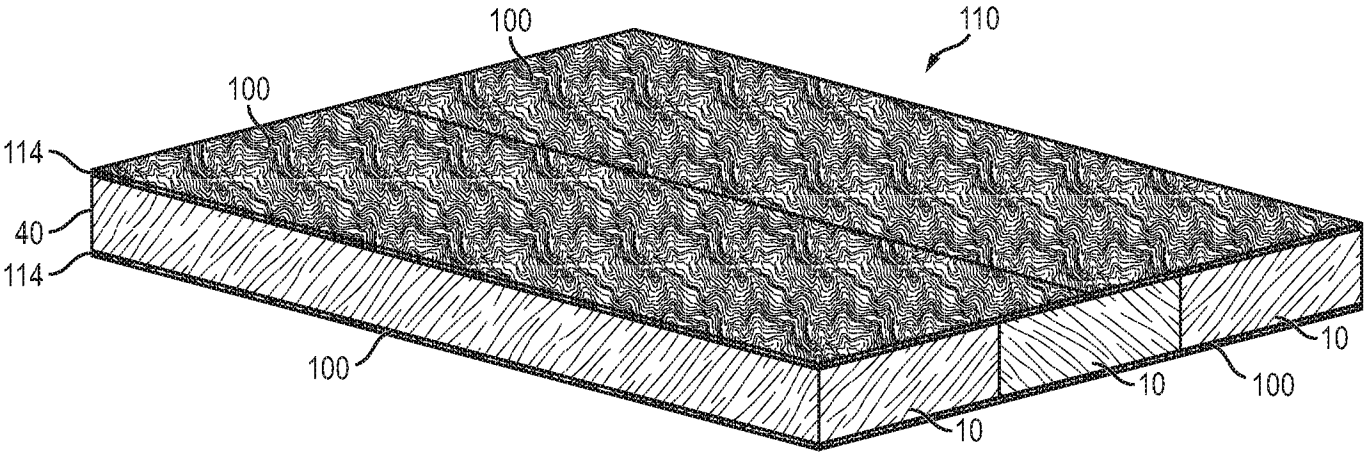
Figure 2D:
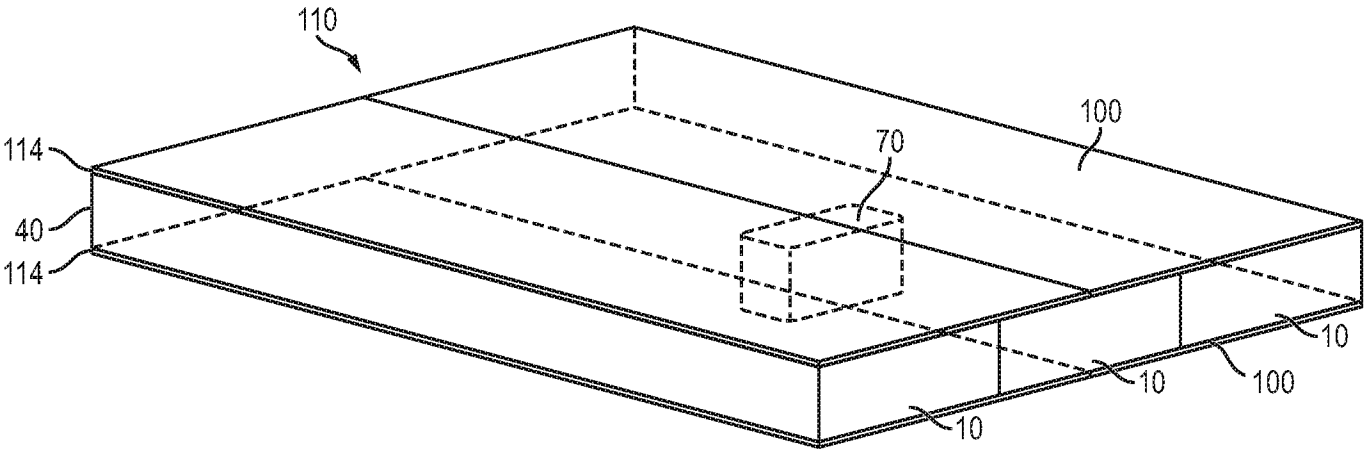

FIG. 2*d* illustrates guitar blank 110 as transparent to show hardwood plug 70 embedded within the blank. Hardwood plug 70 extends completely between hardwood plates 114 so that guitar blank 110 is comprised of hardwood for the entire thickness of the guitar blank within the area of hardwood plug 70. Guitar blank 110 in FIGS. 2*c* and 2*d* includes a majority of material of the blank that is comprised of a lightweight softwood core 40. Guitar blank 110 also includes plates 114 of harder wood on the top and bottom surfaces. The lighter wood of core 40 contributes to formation of an instrument that is relatively light weight, while the harder plates 114 protect the softwood core and hardwood plug 70 provides secure attachment of a guitar bridge.

In one embodiment, the front and back hardwood plates 114 and hardwood plug 70 are formed from Sitka spruce, while the core 40 is formed from paulownia. Sitka spruce has a high strength to weight ratio, making the wood ideal for making plates 114 that provide good protection to softwood core 40 without increasing weight more than necessary. In another embodiment, another softwood, such as balsa or softer varieties of cedar, is used for softwood core 40, and another hardwood, such as maple, walnut, mahogany, rosewood, or any of a variety of more dense woods are used for hardwood plates 114 and hardwood plug 70.

In other embodiments, the materials used for hardwood plates 114 and hardwood plug 70 are mixed and matched. Hardwood plug 70 can be a different material from hardwood plates 114. The two hardwood plates 114 can be different materials from each other. The materials can be selected for their structural and sonic properties. Plates 114 might be a hard wood selected for aesthetics, while hardwood plug 70 is a hard polymer or metal. In another case, the front plate 114 is selected based on a certain hardwood having a desired aesthetic, while the rear plate 114 is selected as the cheapest available hardwood without considering aesthetics. Selection of the materials can be used to configure the sound of a guitar formed from blank 110. For instance, selecting a harder material for plug 70 causes a guitar to have a brighter sound by increasing the mechanical coupling between the front and back hardwood plates 114.

Blank 110 includes a core 40 formed of a soft but musically useful material encased in more rigid plates 114, which are coupled to each other by a rigid hardwood plug 70 through a cross section of the core. Blanks 110 can be stored and handled in the present state without significant worry about damage to the softwood core 40 because most hazards that might damage the softer wood will instead impact hardwood plates 114 and be less likely to cause significant damage. In the manufacturing setting, blanks 110 can be mass produced with less concern for possible damage than with a guitar blank that is formed from only softer wood.

Figure 3A:
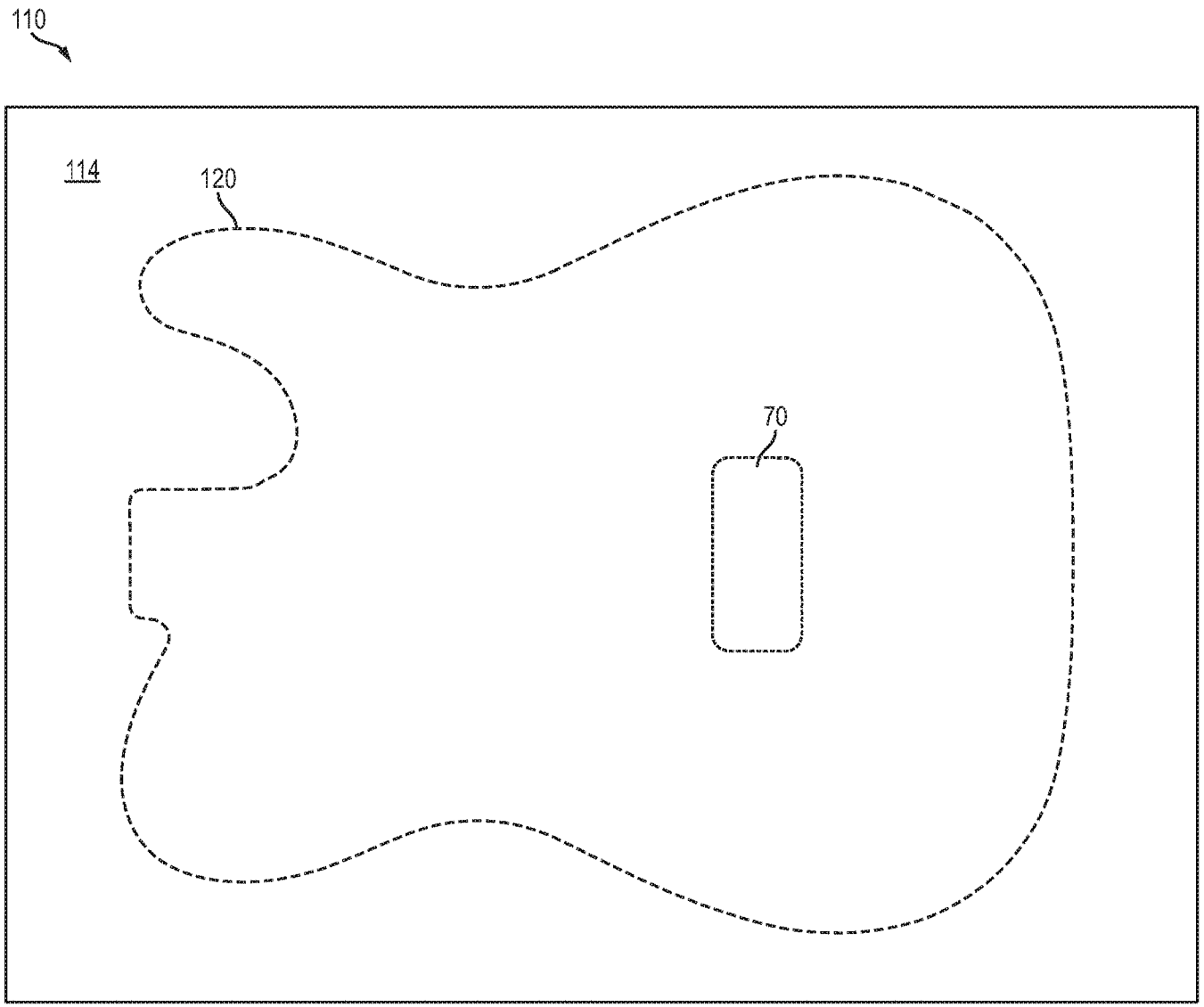
FIGS. 3*a*-3*f* illustrate forming an electric guitar using the guitar blank.

FIGS. 3*a*-3*f* illustrate manufacturing a guitar from guitar blank 110. As mentioned above, hardwood plug 70 is at a location within guitar blank 110 where a bridge of the guitar will be mounted to provide structural support. FIG. 3*a* illustrates the top surface of guitar blank 110 with an outline 120 of a guitar body laid over the blank illustrating the relative position of hardwood plug 70. Outline 120 shows one example guitar body outline, and any other suitable guitar shape can be formed in other embodiments.

Figure 3B:
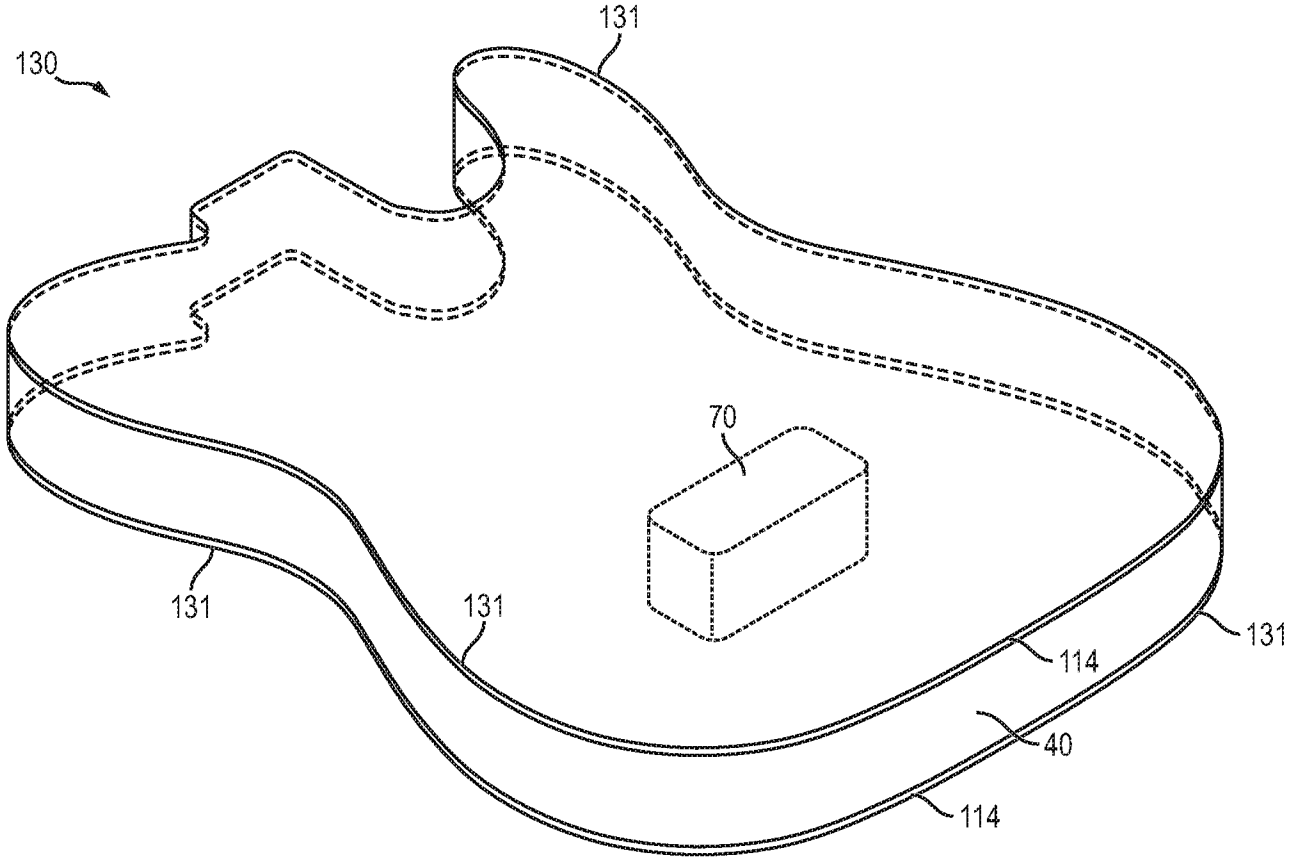

A cut is made through blank 110 along outline 120 to create guitar body 130, illustrated in FIG. 3*b*. Outline 120 is cut using a band saw, reciprocating saw, water cutting tool, laser cutting tool, or other suitable means. After outline 120 is cut, the sides and edges of guitar body 130 can be sanded for a smooth finish. The top and bottom edges 131 of guitar body 130 can be sanded to round the sides of the guitar. Sanding edges 131 only within the thickness of top and bottom plates 114 improves manufacturability by not requiring sanding diagonally across the density transition between plates 114 and core 40. However, blank 110 can be worked into any suitable guitar body shape for guitar body 130, including rounding edges 131 into core 40 or adding a drop top, sculpted heel, belly scarf, etc.

Figure 3C:
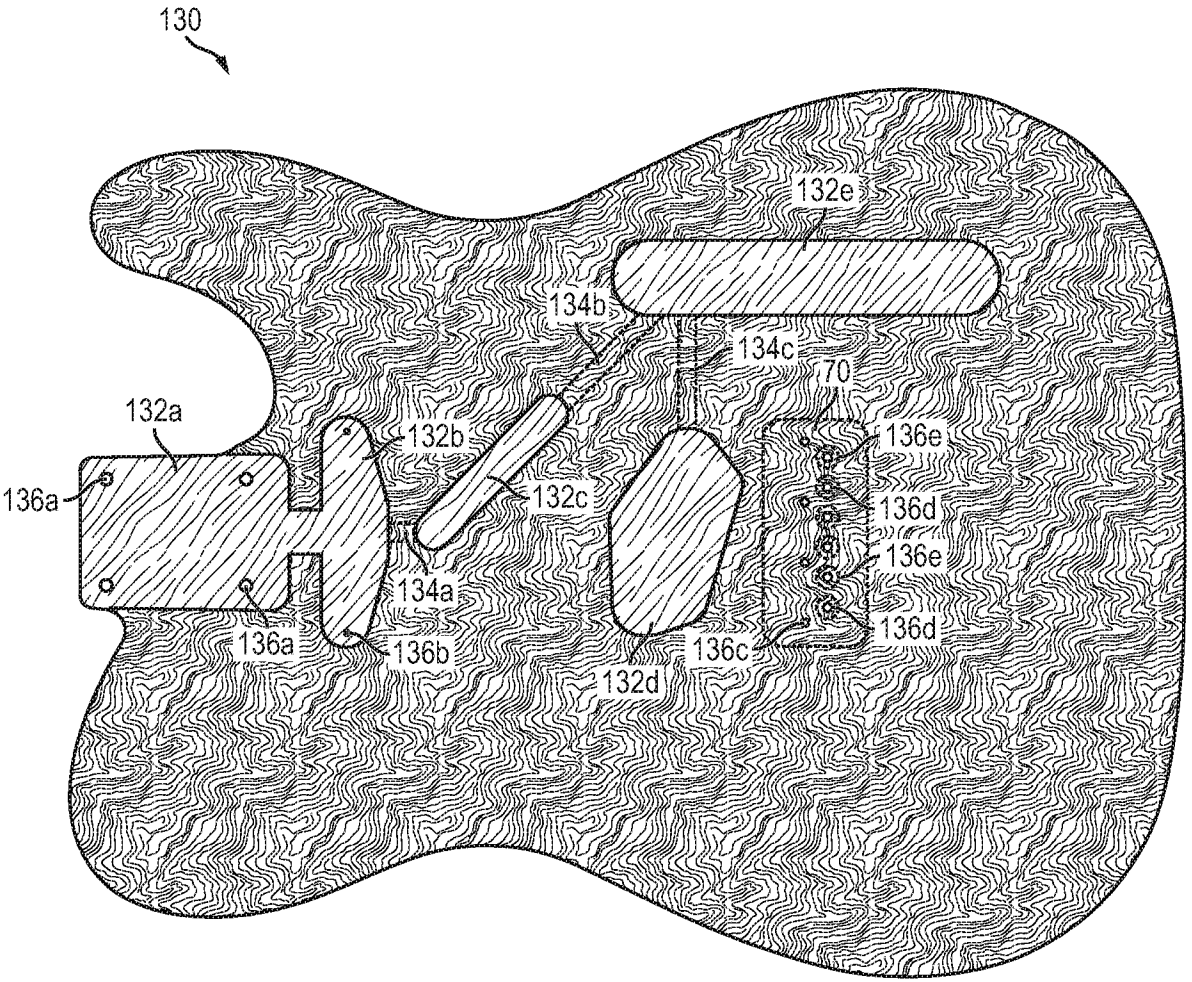

In FIG. 3*c*, guitar body 130 is completed by cutting cavities 132, and drilling holes 134 and 136. In some embodiments, a router is used to form cavity 132. The softer wood of core 40 is visible within cavities 132. Cavity 132*a* is configured to interface with a neck for the guitar. The bottom of the neck is shaped similarly to cavity 132*a* to fit snugly within the cavity. Openings 136*a* are formed to allow screws or bolts to be inserted through the back of guitar body 130 and into the neck to hold the neck onto the body. Alternatively, a guitar neck can be glued into cavity 132*a*.

Cavity 132*b* is configured to fit a magnetic guitar pickup near the neck of the guitar. Screw holes 136*b* are drilled to allow the neck pickup in cavity 132*b* to be screwed down into body 130. Alternatively, a neck pickup can be screwed onto a pick guard to be installed at a later step. Cavity 132*c* is formed to aid in routing of wires between the neck pickup and electronics installed in cavity 132*e*. Wires from the neck pickup are routed through hole 134*a*, cavity 132*c*, and hole 134*b* to get electrical signals from the neck pickup to the electronics. Material is removed between cavities 132*a* and 132*b* to aid in drilling hole 134*a* horizontally to cavity 132*c*. Cavity 132*c* aids in formation of hole 134*b* by allowing a drill bit to be used approximately parallel to the top surface of guitar body 130. Cavity 132*d* is configured to allow room for a bridge pickup. Hole 134*c* is drilled horizontally to allow routing of wires between the bridge pickup and electronics in cavity 132*e*.

Holes 136*c* are drilled at least partially through guitar body 130, within the footprint of hardwood plug 70, as screw holes for installation of a guitar bridge. Holes 136*d* are relatively small holes formed from the top of the guitar, i.e., the surface of the guitar facing the viewer in FIG. 3*c*. Holes 136*e* are larger than holes 136*d*, and formed from the opposite surface of guitar body 130. Together, holes 136*d* and 136*e* extend completely through guitar body 130, and plug 70, to allow guitar strings to be threaded from the back to the front of the guitar. Holes 136*e* are larger so that balls or stoppers on ends of the guitar strings are able to be pulled into body 130, while holes 136*d* are smaller so that the ball is not pulled completely through the body.

Figure 3D:
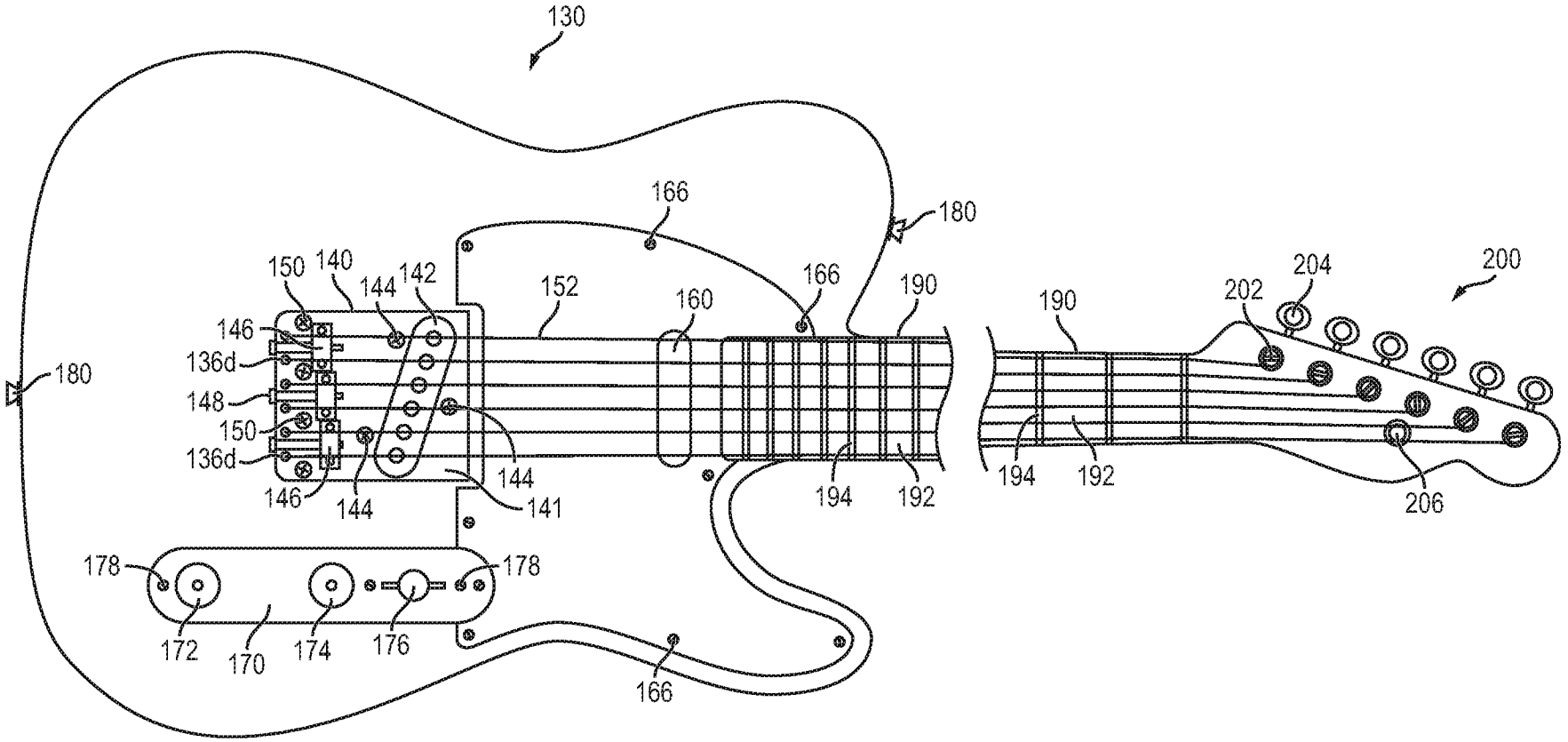

FIG. 3*d* illustrates a completed guitar formed from body 130. Body 130 is optionally covered in paint, lacquer, or another coating. The grain of hardwood plates 114 and softwood core 40 is visible through the coating in some embodiments, but is not illustrated in FIG. 3*d* to help illustrate other parts of the guitar. A bridge assembly 140 is installed on guitar body 130 over hardwood plug 70. The bridge assembly includes a bridge plate 141 and a bridge pickup 142 attached to the bridge plate by screws 144. Bridge pickup 142 fits within cavity 132*d* when bridge plate 141 is installed on body 130. A plurality of saddles 146 are held onto bridge plate 141 with adjustment screws 148. Screws 148 are turned to adjust the position of saddles 146.

Screws 150 are threaded into holes 136*c* of body 130 to hold bridge plate 141 onto body 130. Holes 136*c* are within the footprint of hardwood plug 70, which gives the threads of screws 150 significantly better grip than if the screws were threaded into the softer core 40. Strings 152 are threaded through openings 136*d* and 136*e* of body 130, and corresponding openings in bridge plate 141, then over saddles 146. While only three saddles 146 are shown, with the strings 152 sharing saddles in pairs, other embodiments include a separate saddle for each string.

Neck pickup 160 is installed in cavity 132*b*, and then pick guard 162 is installed over the neck pickup. Screws 166 are used to attach pick guard 162 to body 130. An electronics assembly 170 is installed over cavity 132*e*. Electronics assembly 170 includes potentiometers, switches, and other electronic circuit components necessary to route and process audio signals from pickups 142 and 160. In some embodiments, electronics assembly 170 includes other components on a circuit board within cavity 132, such as passive filters formed from capacitors, inductors, etc., or active audio processing circuitry formed on an integrated circuit.

Electronics assembly 170 includes knob 172, knob 174, and switch 176, used by a player of the guitar to manipulate how the electronics assembly processes audio from pickups 142 and 160. In one embodiment, knob 172 is a volume potentiometer used to change output volume, knob 174 is a tone knob, and switch 176 is used to select between pickups 142 and 160 for output. Switch 176 is attached to electronics assembly 170 by screws 177. Electronic assembly 170 is attached to body 130 by screws 178. Strap buttons 180 are installed on the outside edge of body 130 to allow a strap to be attached to body 130. The strap is placed around a player's neck during use of the guitar to support the guitar's weight.

An end of neck 190 is inserted into cavity 132*a* and attached to body 130 by screws through the back of the body. Neck 190 includes a fretboard 192 and a plurality of frets 194. Headstock 200 is disposed on an end of the neck opposite body 130. Headstock 200 includes machine heads comprised of tuning pegs 202 and knobs 204 connected by gears on the back side of the headstock. Strings 152 are routed from bridge 140 and wrapped around tuning pegs 202. Knobs 204 are turned by hand or using a tool to adjust tension on strings 152 and tune the guitar. A string tree 206 helps keep the longer strings in the guitar's nut.

Figure 3E:
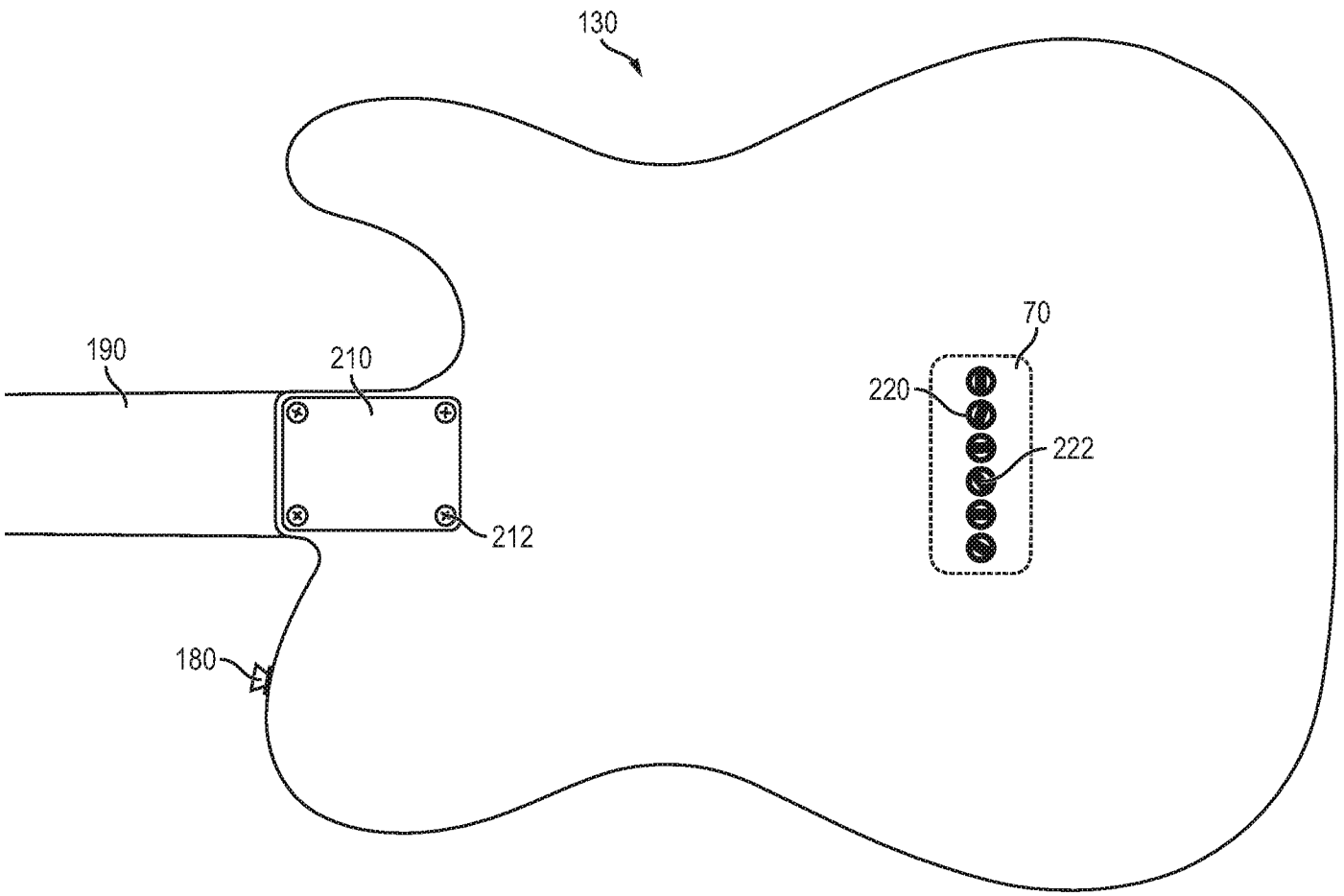

FIG. 3*e* illustrates the back side of body 130 with the guitar assembled. A plate 210 is placed over body 130 opposite neck 190 to strengthen the back surface of the body against screws 212. Screws 212 are inserted through openings in plate 210 and openings 136*a* in cavity 132*a*, and then screwed into neck 190 to hold the neck in place. A plurality of ferrules are placed within openings 136*e* to strengthen the point of contact between body 130 and balls 222 attached to the ends of the strings 152. The outline of hardwood plug 70 is illustrated to show that the strings are threaded through the hardwood plug rather than the softwood core 40.

Figure 3F:
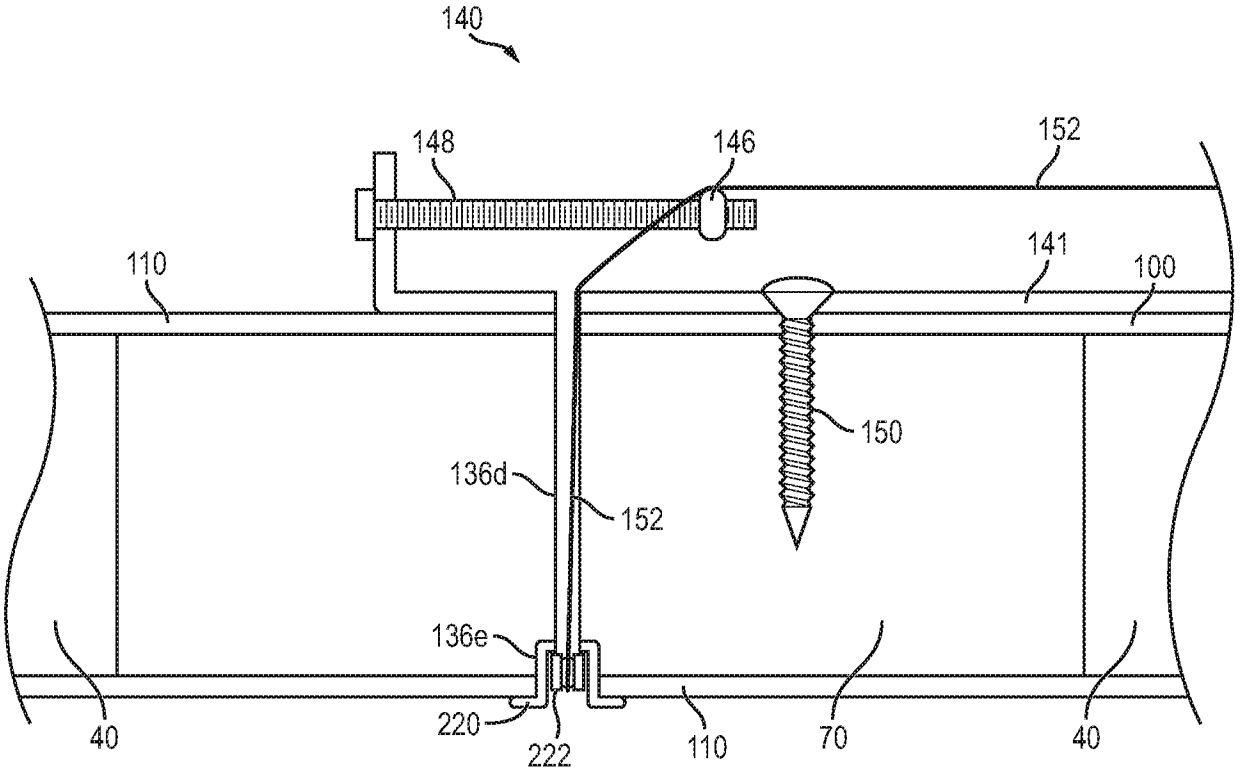

FIG. 3*f* illustrates a partial cross-section of body 130 through hardwood plug 70. String 152 is routed through hardwood plug 70 from ferrule 220 to bridge plate 141. Ferrule 220 is a fairly thin metallic piece that fits within opening 136*e*. Ball 222 is smaller than opening 136*e*, so that the ball fits within ferrule 220. However, ball 222 is larger than opening 136*d* to stop string 152 from being pulled completely through body 130.

Strings 152 apply tension to body 130 for essentially the entire lifetime of the guitar. Having hardwood plug 70 at the location where strings 152 are routed through body 130 increases the resistance of the guitar body to warpage due to the string tension. The hardwood material of plug 70 is stronger and stiffer than the softwood material of core 40, thus increasing resistance to warpage from string tension. The hardwood material of hardwood plug 70 also has a positive effect on the guitar tone, and the guitar's tone to be configured by changing the shape and material of the hardwood plug.

Plug 70 also gives screws 150 a more robust material to grip into than the softer wood of core 40 would provide. Screws 150 include threads that spiral around the screws. The attachment of screws 150 to body 130 depends on the threads keeping a grip on the surrounding wood. Screws 150 can be pulled out of wood if the wood around the screws fails structurally. The denser wood of hardwood plug 70 is stronger than the less dense softwood core 40, making pulling screw 150 straight out of hardwood plug 70 significantly harder than pulling the screw out of softwood core 40 would be. The softwood material of core 40 fails under less pressure than the hardwood material of plug 70. The hardwood of plug 70 is much more robust between the threads of screws 150, making pulling the screws out of body 130 much more difficult. The strength of screws 150 in guitar body 130 is significantly improved by the addition of plug 70 within core 40.

Guitar body 130 is made mostly out of a light weight softwood, with select portions of the body formed of a robust hardwood to improve manufacturability and resistance to wear and tear. The softwood core 40 of guitar body 130 results in a guitar that is relatively light weight, which improves ergonomics. The guitar can be used for a longer period of time relative to purely hardwood instruments without significantly fatiguing the player. Hardwood plates 114 on the two major surfaces of the guitar provide strength to shield softwood core 40 from impact damage. Hardwood plates 114 protect softwood core 40 from damage that can occur when handling the body during manufacturing and use.

Hardwood plug 70 is embedded within core 40 between the two hardwood plates 114. Hardwood plug 70 is strategically located only where a robust physical attachment of components to body 130 is required. In the disclosed embodiment, hardwood plug 70 is only under bridge 140 so that attachment screws 150 are given a harder wood to thread into, and the stronger wood also helps resist string tension. Hardwood plug 70 provides a stable surface for bridge 140 and attachment screws 150. In other embodiments, plug 70 might be bigger to give improved physical support to other guitar components. In some embodiments, multiple physically separate plugs are embedded within core 40 to provide strength to multiple physically distant guitar components.

Hardwood plug 70 in core 40, and plates 114 disposed over both sides of core 40, allows guitar body 130 to be made almost entirely out of lighter weight wood, reducing weight of the guitar without significantly increasing the risk of damage due to mishandling or warpage due to string tension over time, and without compromising the connection strength of bridge 140 to body 130. The softwood guitar body construction with hardwood plates and plug allows a guitar body to be made of light weight material while being physically protected and increasing structural integrity. A guitar made with guitar blank 110 is light in weight while being resistant to damage during manufacturing and distortion from string tension during use.

Figure 4A:
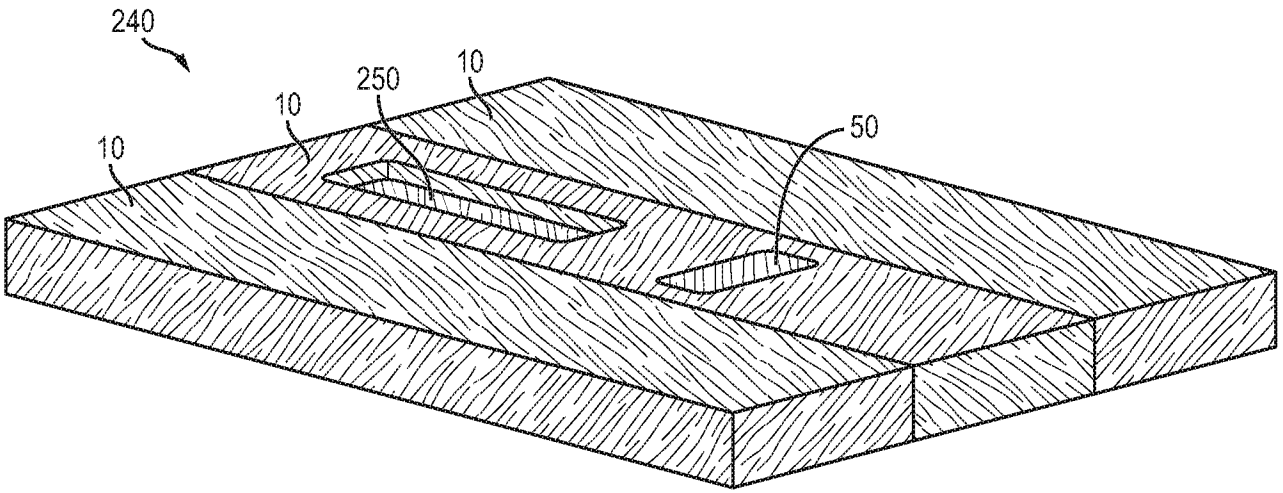
FIGS. 4*a*-4*i* illustrate forming a second electric guitar embodiment using a different guitar blank configuration.

FIGS. 4*a*-4*i* illustrate a second guitar embodiment formed using a different hardwood plug configuration. FIG. 4*a* illustrates a core 240 with opening 50 formed through the core, as in FIG. 1*e*. Opening 50 can be the same size as in the previous embodiment, or may be resized to accommodate the requirements of a specific bridge being used with the guitar. In addition to opening 50, a recess 250 is formed. Recess 250 is formed only partially through softwood boards 10 using a router or other appropriate woodworking tool. Recess 250 is positioned between where a neck attaches to the guitar and where a tremolo bridge will attach.

Figure 4B:
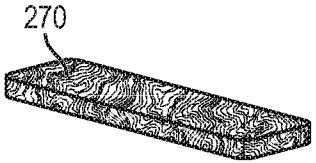
Figure 4C:
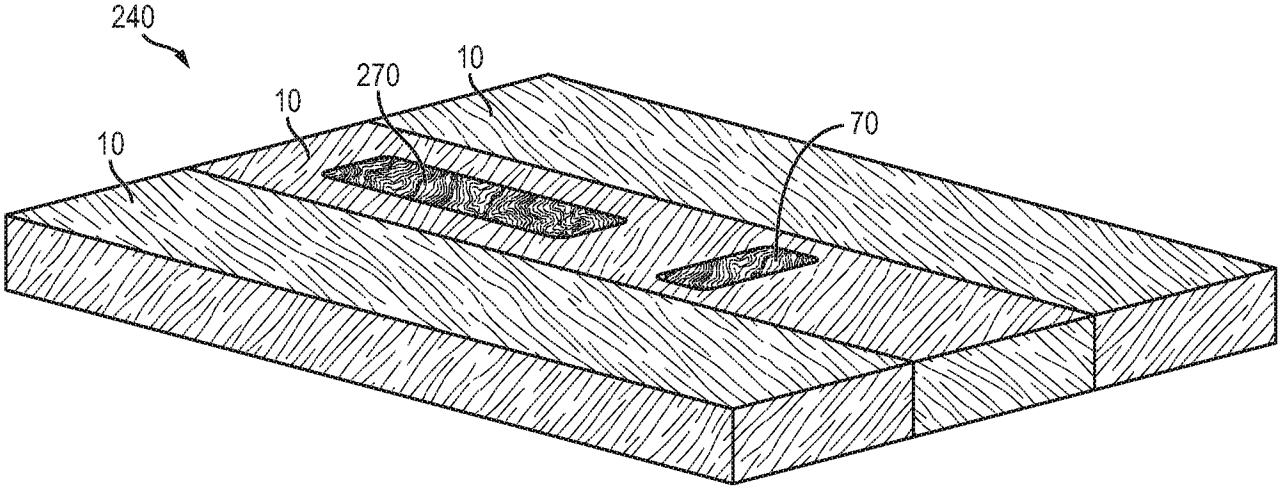

FIG. 4*b* illustrates a hardwood plug 270 configured to fill recess 250. Hardwood plug 270 is made of a material that is denser than softwood boards 10, e.g., any of the materials mentioned above with respect to hardwood plug 70. Hardwood plug 270 is formed using any appropriate woodworking tools. In some embodiments, recess 250 and hardwood plug 270 are both made using computer controlled mechanisms that allow accurate matching of the sizes. FIG. 4*c* illustrates hardwood plug 70 disposed in opening 50 and hardwood plug 270 disposed in recess 250.

Figure 4D:
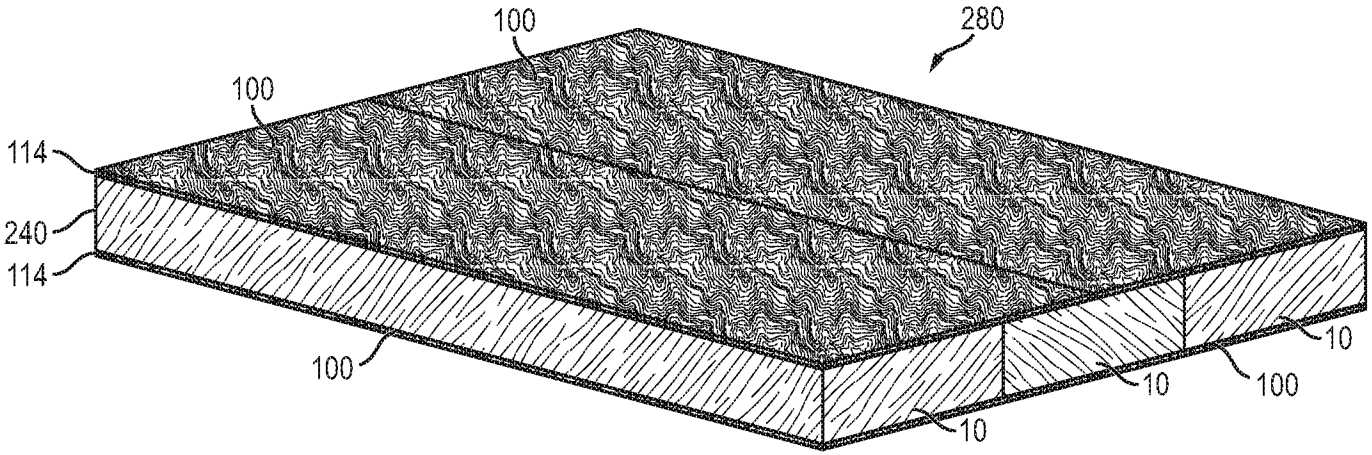
Figure 4E:
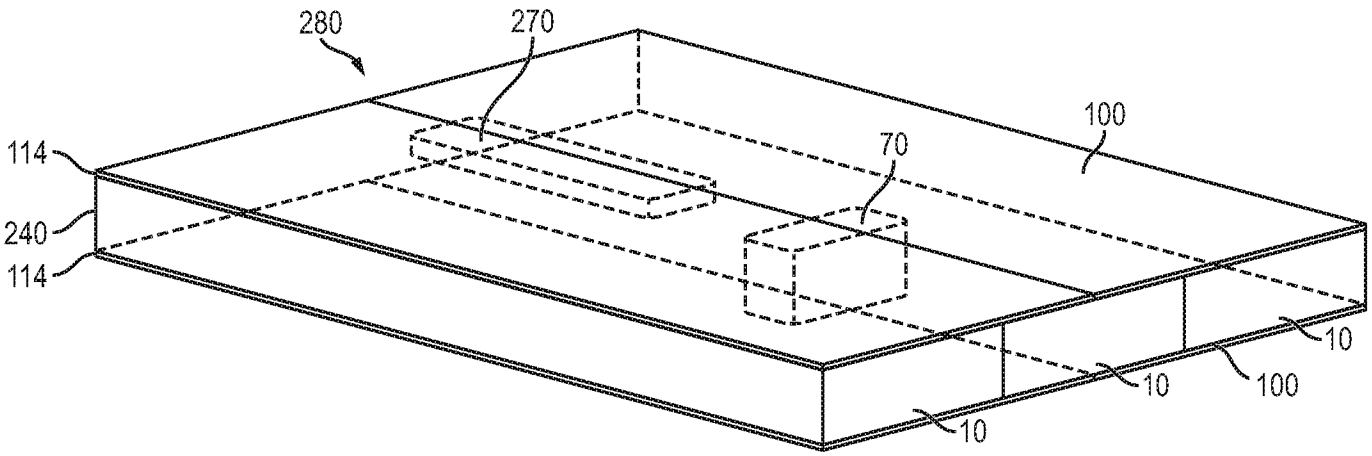

FIGS. 4*d* and 4*e* illustrate a guitar blank 280, similar to guitar blank 110 in FIGS. 2*c* and 2*d*. Guitar blank 280 includes softwood core 240 with embedded hardwood plugs 70 and 270. Hardwood plates 114 are disposed over the two major surfaces, top and bottom in FIGS. 4*d* and 4*e*, as illustrated in FIG. 2*b*. Hardwood plates 114 physically protect softwood core 240 as described above.

Figure 4F:
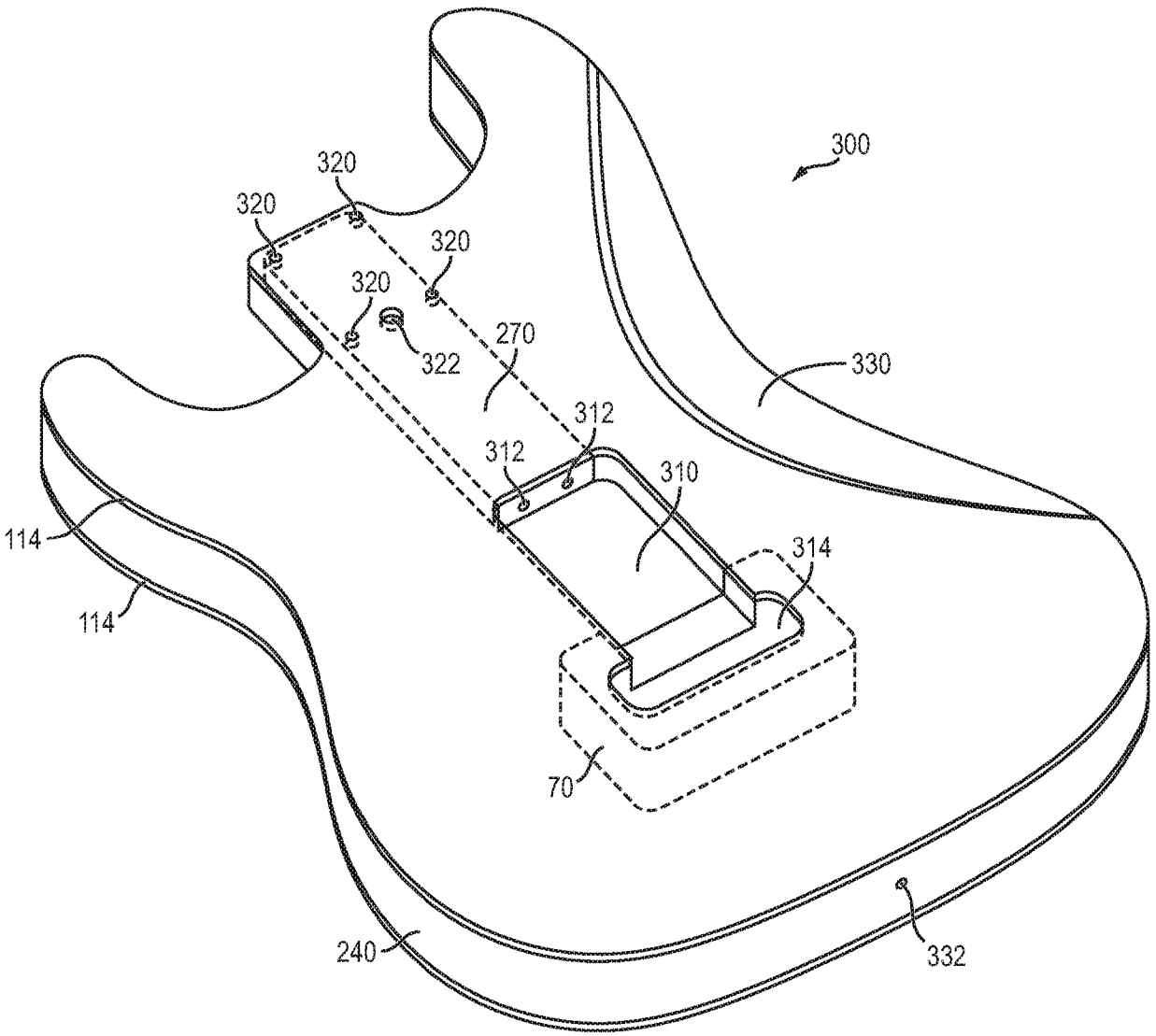
Figure 4G:
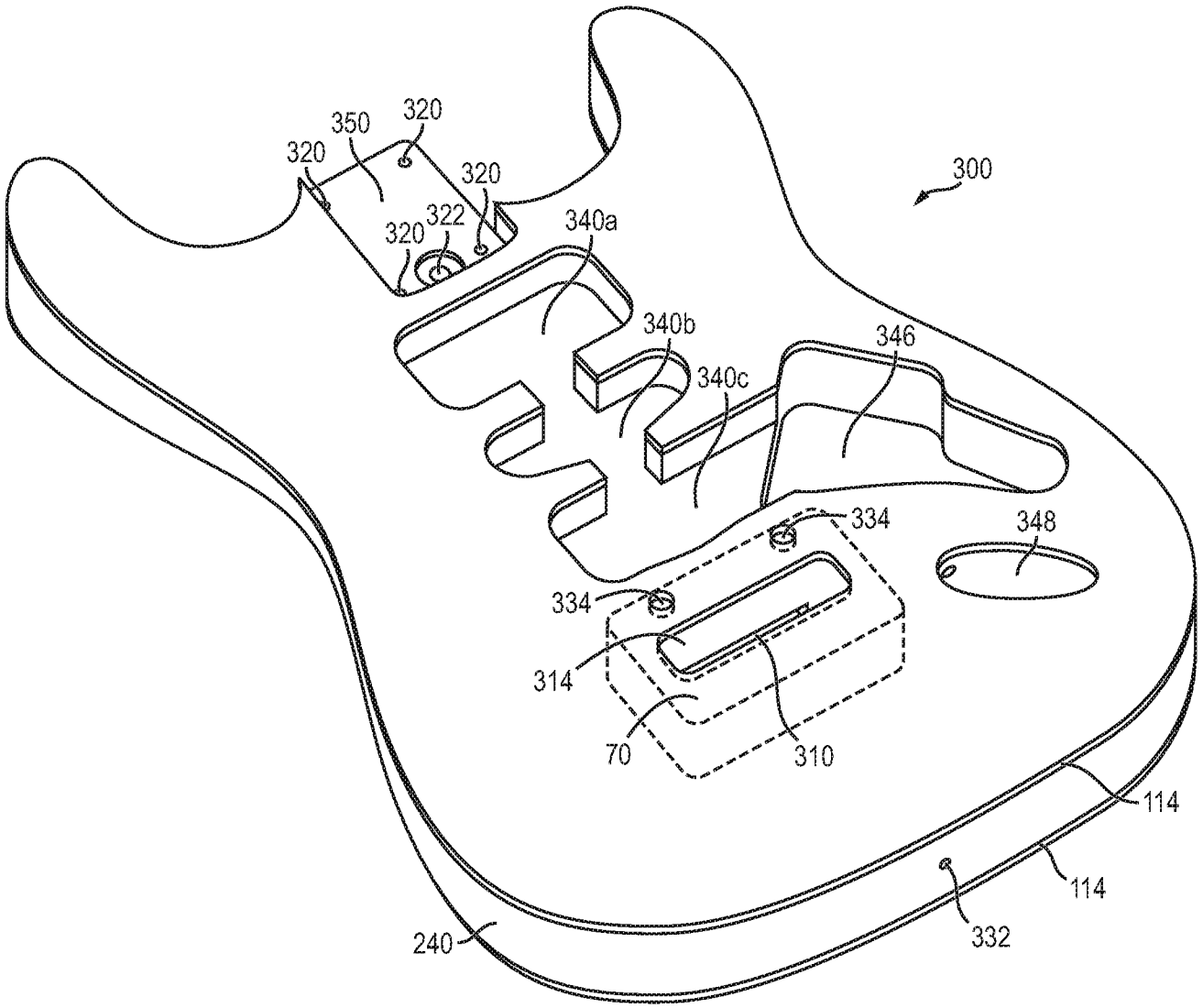

FIGS. 4*f* and 4*g* illustrate an electric guitar body 300 formed from guitar blank 280. FIG. 4*f* illustrates the back side. A tremolo cavity 310 is formed between hardwood plug 70, where a tremolo bridge will be attached, and hardwood plug 270, where springs of the tremolo bridge will be attached. Screw holes 312 are formed in an exposed end of hardwood plug 270 for attachment of the tremolo bridge springs. Tremolo cavity 310 only goes partially through guitar body 300, exposing softwood core 240, while an opening 314 is formed completely through body 300 at hardwood plug 70. Opening 314 allows the tremolo bridge to extend through body 300 from the strings to the bottom of the body, where springs will attach the tremolo bridge to hardwood plug 270. Openings 320 are formed through body 300, including an end of hardwood plug 270 opposite cavity 310, for attachment of a guitar neck. Openings 320 are similar to openings 136*a* in FIG. 3*c*. An opening 322 is formed through body 300 under where a neck will be attached. A mechanism for adjusting the angle of the neck relative to body 300 will be disposed between the neck and body, and is adjusted using a tool inserted through opening 322. A belly scarf 330 is cut into the side of body 300 for comfort of the player. A screw hole 332 for attachment of strap button 180 is formed at the bottom end of guitar body 300.

FIG. 4*g* illustrates the front side of guitar body 300. Openings 334 are formed through hardwood plate 114 and into hardwood plug 70 for installation of pivot pins used with the tremolo bridge. In some embodiments, metal inserts with internal threading are disposed in openings 334 so that the pivot pins are removable and replaceable screws. A plurality of recesses 340*a*-340*c* is formed in body 300 for installation of guitar pickups. Recess 346 provides a location to install electronics of the guitar, and recess 348 is for installation of an output audio jack. Neck recess 350 is formed similarly to cavity 132*a* in FIG. 3*c*. Openings 320 and 322 are seen within neck recess 350. Neck recess 350 is not formed all the way to hardwood plug 270, but could expose the hardwood plug in another embodiment.

Figure 4H:
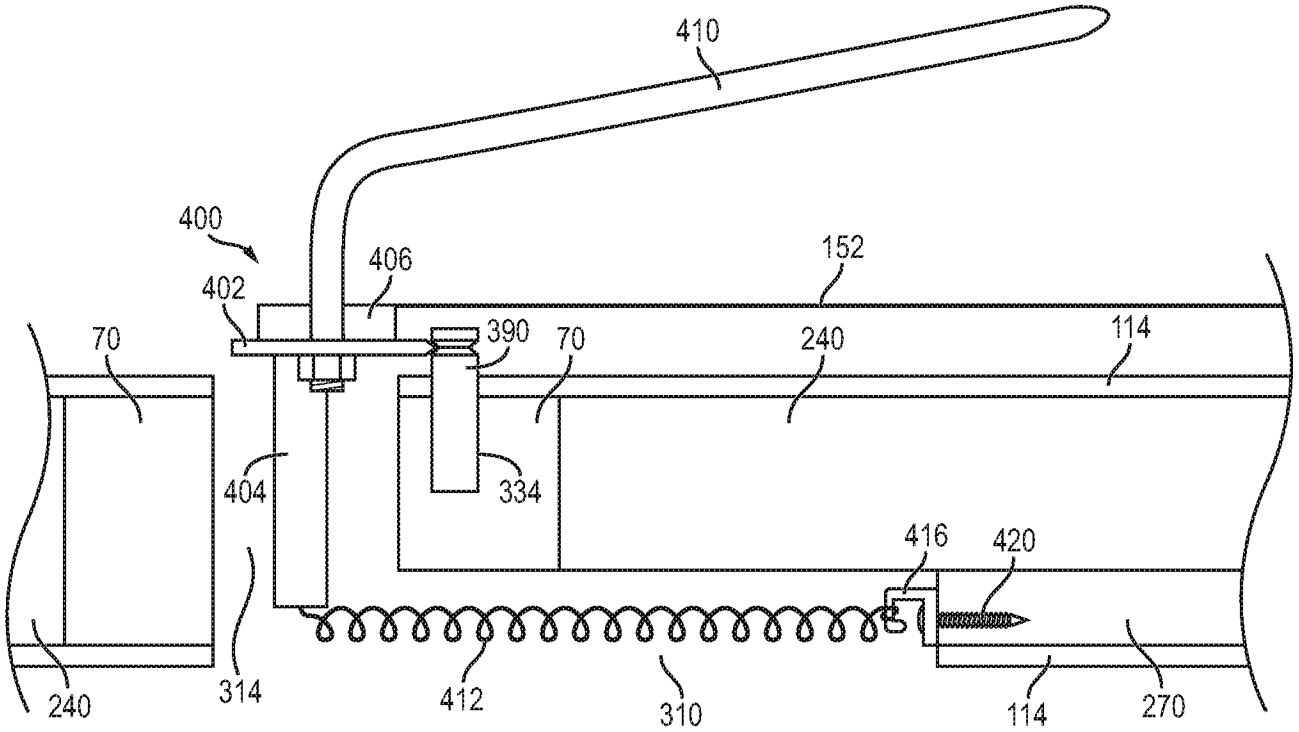
Figure 4I:
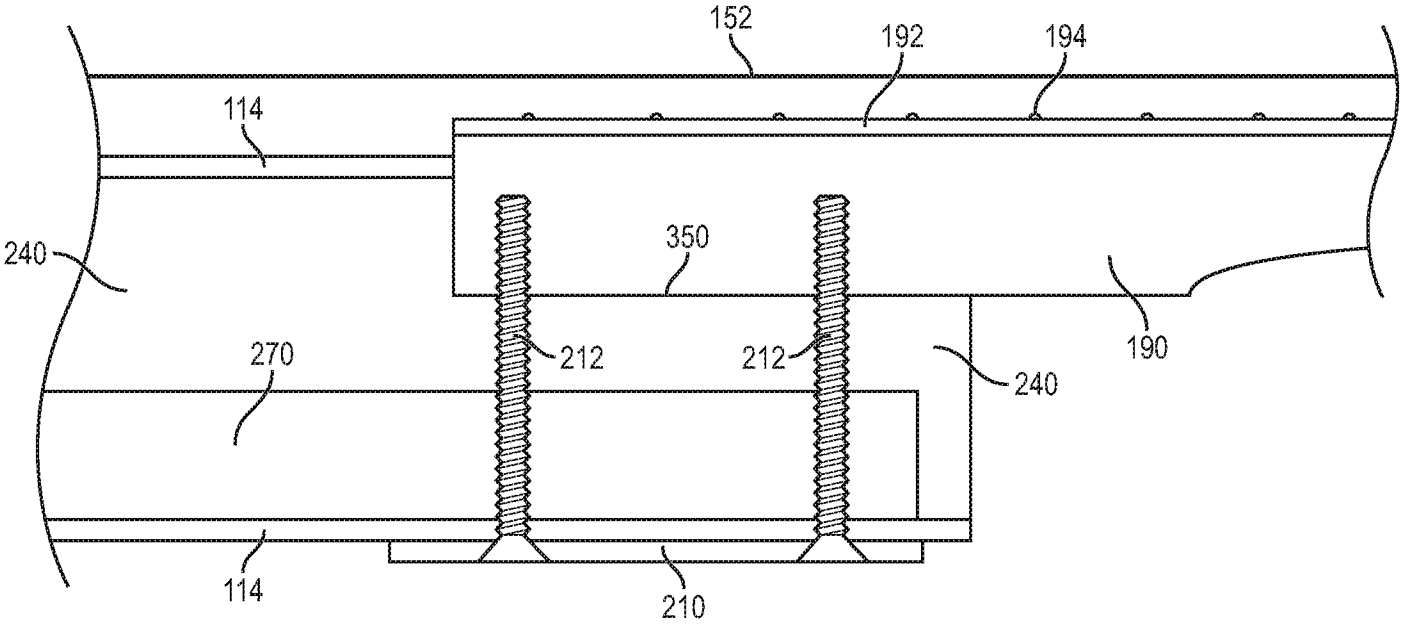

FIGS. 4*h* and 4*i* illustrate partial cross-sections of a completed guitar with pivot pins 390 and a tremolo bridge 400 installed into hardwood plugs 70 and 270. Pivot pins 390 operate as a fulcrum for pivoting of tremolo bridge 400.

Pivot pin 390 includes a recess that pivot plate 402 of bridge 400 sets in. Tailpiece block 404 is attached to plate 402 and extends through opening 314. Saddles 406 are attached to pivot plate 402 opposite tailpiece block 404. Strings 152 are routed through saddles 406 and tailpiece block 404, and are attached at the bottom of the tailpiece block. A tremolo arm 410 is attached to pivot plate 402 for manual control of tremolo bridge 400 by a player. One or more springs 412 are attached from the bottom of tailpiece block 404 to hardwood plug 270 to counter-balance the tension of strings 152. Tremolo bridge 400 is attached to hardwood plug 70 by the pressure applied by strings 152 and springs 412. One or more hooks 416 is attached to hardwood plug 270 by screws 420 or another fastener to attach the springs 412 to hardwood plug 270.

Hardwood plug 270 provides a better medium for attachment of screws 420 and other fasteners than the softwood boards 10, without adding significantly to the weight of the instrument. Hardwood block 270 provides a more secure connection for spring 412 to body 300 while still allowing the instrument to be formed from a large percentage of lighter wood. Hardwood plug 70 also provides a more secure attachment for pivot pins 390 than softwood core 240. The pressure of bridge 400 against pivot pins 390 could deform or damage softwood core 240, but hardwood plug 70 is better suited to withstand the pressure applied by springs 412 and strings 152.

FIG. **4*i* illustrates another cross section taken through the other end of hardwood core 270, where neck 190 is installed. Neck 190 is disposed in neck recess 350 and attached by bolts or screws 212 as above. Bolts 212 extend through hardwood block 270, which gives the bolts a robust anchor to body 300. In addition, bolts 212 through hardwood plug 270 help the hardwood plug resist the tension of springs 412, which are coupled at an opposite end of the hardwood plug from neck 190**.

While one or more embodiments of the present invention have been illustrated in detail, the skilled artisan will appreciate that modifications and adaptations to those embodiments may be made without departing from the scope of the present invention as set forth in the following claims.

What is claimed:

1. A method of making a musical instrument, comprising:
providing a softwood core;
forming an opening in the softwood core;
disposing a first hardwood plug in the opening of the softwood core;
disposing a first hardwood plate over a first surface of the softwood core;
disposing a second hardwood plate over a second surface of the softwood core, wherein the first hardwood plug extends from the first hardwood plate to the second hardwood plate; and
attaching a bridge to the first hardwood plug.

2. The method of claim 1, further including:
forming an opening through the first hardwood plug; and
disposing a string through the opening of the first hardwood plug.

3. The method of claim 1, further including attaching a bridge to the first hardwood plug using a wood screw.

4. The method of claim 1, further including:
forming a recess in the softwood core;
disposing a second hardwood plug in the recess; and
attaching the bridge to the second hardwood plug by a spring.

5. The method of claim 1, further including cutting the softwood core, first hardwood plate, and second hardwood plate into an instrument body.

6. The method of claim 5, further including:
attaching an instrument neck to the instrument body; and
providing a plurality of instrument strings tensioned from the first hardwood plug to the instrument neck.

7. A method of making a musical instrument, comprising:
providing a core comprising a first material;
disposing a plug comprising a second material in the core, wherein the second material is denser than the first material;
disposing a first plate comprising a third material over the core and plug, wherein the third material is denser than the first material; and
disposing a second plate comprising a fourth material over the core and plug opposite the first plate, wherein the fourth material is denser than the first material.

8. The method of claim 7, further including attaching a bridge to the plug.

9. The method of claim 8, further including attaching the bridge to the plug using a fastener extending through the bridge and into the plug.

10. The method of claim 7, wherein the second material, third material, and fourth material are all the same type of wood.

11. The method of claim 7, wherein the first material is balsa or paulownia.

12. The method of claim 7, further including:
cutting the core, first plate, and second plate into a musical instrument body;
attaching a neck to the musical instrument body; and
disposing a string extending from the plug to the neck.

13. The method of claim 12, further including threading the string through an opening in the plug.

14. A musical instrument, comprising:
a softwood core;
a hardwood plug disposed in the softwood core;
a first hardwood plate disposed over the softwood core and hardwood plug; and
a bridge attached to the hardwood plug.

15. The musical instrument of claim 14, further including a fastener disposed through the bridge and into the hardwood plug.

16. The musical instrument of claim 14, further including a string extending through an opening of the hardwood plug.

17. The musical instrument of claim 16, wherein the string applies tension to the hardwood plug.

18. The musical instrument of claim 14, further including a second hardwood plate disposed over the softwood core and hardwood plug opposite the first hardwood plate, wherein the hardwood plug extends from the first hardwood plate to the second hardwood plate.

19. The musical instrument of claim 14, wherein the softwood core comprises balsa or paulownia.

20. The musical instrument of claim 19, wherein the hardwood plug and first hardwood plate comprise spruce.

21. A musical instrument, comprising:
a core;
a first plug disposed in the core, wherein a density of the first plug is greater than a density of the core;
a plate disposed over the first plug and core;
a bridge attached to the first plug; and
a string disposed through the first plug and bridge.

22. The musical instrument of claim 21, further including a second plug disposed in the core.

23. The musical instrument of claim 22, further including an instrument neck attached to the second plug.

24. The musical instrument of claim 23, wherein the core extends between the instrument neck and second plug.

25. The method of claim 7, further including cutting the softwood core, first hardwood plate, and second hardwood plate into an instrument body after disposing the first plate and second plate over the core and plug.

* * * * *